US006700045B2

(12) United States Patent
Del Valhe

(10) Patent No.: US 6,700,045 B2
(45) Date of Patent: Mar. 2, 2004

(54) CONSTRUCTIVE ARRANGEMENT DISPOSED IN A TUNING MECHANISM FOR PERCUSSION INSTRUMENTS

(76) Inventor: Marino Rampazzo Del Valhe, Rua André Bloch, No. 52, Vila Mazzei, São Paulo - SP (BR)

( * ) Notice: Subject to any disclaimer, the term of this patent is extended or adjusted under 35 U.S.C. 154(b) by 0 days.

(21) Appl. No.: 10/173,061

(22) Filed: Jun. 17, 2002

(65) Prior Publication Data

US 2002/0189424 A1 Dec. 19, 2002

(30) Foreign Application Priority Data

Jun. 18, 2001 (BR) ..... 8101420 U

(51) Int. Cl.[7] ..... G10D 13/02
(52) U.S. Cl. ..... 84/413; 84/411 R; 84/411 A
(58) Field of Search ..... 84/413, 411 R, 84/411 A

(56) References Cited

U.S. PATENT DOCUMENTS 4,206,681 A * 6/1980 Kluczynski et al. ..... 84/411 R
4,693,163 A * 9/1987 Hsieh ..... 84/413
4,790,229 A * 12/1988 Hoshino ..... 84/413

* cited by examiner

*Primary Examiner*—Shih-Yung Hsieh
(74) *Attorney, Agent, or Firm*—Steinberg & Raskin, P.C.

(57) ABSTRACT

A constructive arrangement disposed in a tuning mechanism for percussion instruments having a substantially parallelepiped-shaped body having a front face and an upper portion. The front face of the body defines a lower quadrangular recess extending through the parallelepiped-shaped body. The upper portion of the body defines an inverted T-shaped recess having a horizontal and lower part having the same depth as the lower quadrangular recess. A vertical and upper part of the inverted T-shaped recess has a depth which is equivalent to half the depth of the parallelepiped-shaped body.

14 Claims, 2 Drawing Sheets

CONSTRUCTIVE ARRANGEMENT DISPOSED IN A TUNING MECHANISM FOR PERCUSSION INSTRUMENTS

FIELD OF THE INVENTION

This invention relates to a constructive arrangement disposed in a tuning mechanism for percussion instruments and, more specifically, to a constructive arrangement provided to the retention element of the tuning stem on the side wall of the percussion instrument, commonly referred to as clamp, which is fastened to the side wall of the instrument box to receive by threading in its upper face the lower end of a tuning stem. The upper end of the tuning stem is adjustably fitted to the mounting and retaining hoop of the musical instrument skin.

BACKGROUND OF THE INVENTION

As is well known by those skilled in the art, all percussion instruments are provided with a tuning mechanism which acts either directly or indirectly upon the instrument's skin in order to stretch it.

Generally, such tuning mechanisms are provided with a piece, commonly referred to as a clamp, which is fastened to the outer side of the musical instrument box. The clamp is axially provided with a threaded hole in its upper portion to which the threaded lower end of a stem is adapted, the opposite upper end of such stem being mounted on a hoop which acts directly upon the musical instrument.

Despite being widely used nowadays, such a piece referred to as a clamp has many inconveniences, for example the fact that such clamp has a specific fastening way for each model of percussion instrument which requires a great variety of models and sizes of clamps for each particular percussion instrument.

Another inconvenience of such a conventional piece is that it does not accept any type of radial adjustment in the tuning stem related to the clamp, so that its application is restricted to specific instruments.

Another inconvenience of such a conventional piece is its singular and unchangeable finish, which would require the existence of a great number of different models and types of clamps in stock and in the production line being compatible with the quantity of the models and types of instruments in which they are used.

OBJECTS AND SUMMARY OF THE INVENTION

It is therefore an object of this invention to provide a constructive arrangement disposed in a tuning mechanics for percussion instruments which is provided with a piece referred to as a clamp which can accept an adjustment in the tuning stem in relation to the body of the percussion box, notwithstanding such clamp being fixed together with such box.

Another object of this invention is to provide a constructive arrangement disposed in a tuning mechanism for percussion instruments which is adjustable and can be used in a number of models of percussion instruments, thus minimizing the variety of models and sizes of clamps required to conform with all models of specific instruments available.

Another object of this invention is to provide a constructive arrangement disposed in a tuning mechanism for percussion instruments which would accept any type of radial adjustment of the stem relative to the clamp, which makes the assembly of the instrument, and the tuning mechanism thereof, easier.

Another object of this invention is to provide a constructive arrangement disposed in a tuning mechanism for percussion instruments that would have variable finishes allowing the provision of a variety of models and types of clamp finishes for the same tuning mechanism.

These and other objects and advantages of this invention are reached by providing a Constructive arrangement disposed in a tuning mechanism for percussion instruments comprising of a substantiality parallelepiped-shaped solid body, which is incorporated in its slightly bulged front face with a lower quadrangular recess, such lower quadrangular recess extending almost through the whole depth of the parallelepiped-shaped body, and an inverted "T" recess in its upper portion, the horizontal and lower part of such recess having the same depth of the lower quadrangular recess, while the vertical and upper part of the inverted "T" recess, it has a depth which is equivalent to half the depth of the parallelepiped-shaped body, due to the fact that a trough-like insert is centrally and vertically incorporated into the upper middle portion of such body, such trough-like insert together with the inverted "T" upper recess defining an adjustably fitted bed of an internally threaded tubular sleeve provided with a rectangular base, which is snugly and able to slide fitted into such bed. The end of the tuning stem is axially threaded to said sleeve and such end going through the whole length of the tubular sleeve and being self-threading fastened to the intermediate horizontal wall which is defined between the upper inverted "T" recess and the lower quadrangular recess. A through-hole is defined in the bottom wall of such lower quadrangular recess coinciding with a tubular projection which extends orthogonally from the back wall of said solid parallelepiped-shaped body. The projection is fitted into a corresponding hole provided in the percussion instrument side wall, both being pierced through by a fastening screw which has a free end disposed into the lower quadrangular recess wherein a check nut is received. The whole assembly which is mounted and adjusted with respect to the percussion instrument is covered with a finish case having a parallelepiped-shaped contour with a half-oblong recess disposed in the upper face thereof so as to ensure the press-fit of the finish case to the sound body, such case covering the whole assembly.

BRIEF DESCRIPTION OF THE DRAWINGS

This invention is described in more detail hereinafter with reference to the accompanying drawings, wherein.

DETAILED DESCRIPTION OF THE INVENTION

Figure 3:
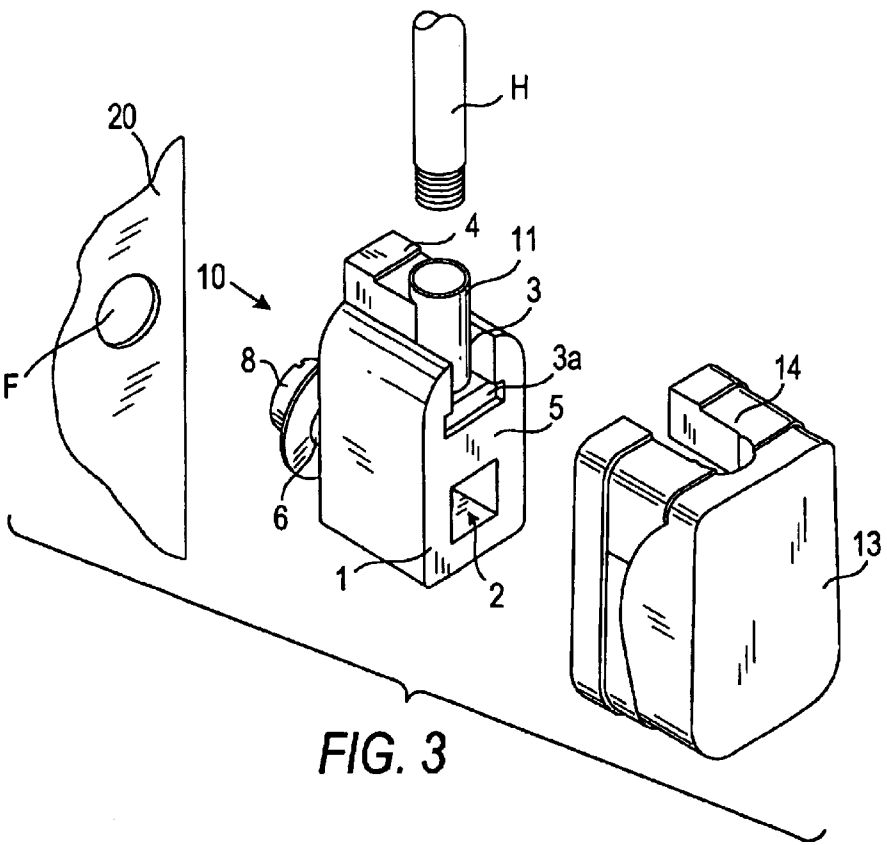
FIG. 3 is a perspective exploded and front view of the tuning mechanism, wherein the solid body not provided with the finish case is shown which is then represented beside it.

Referring to the drawings, the constructive arrangement disposed in the tuning mechanism for percussion instruments in accordance with the invention comprises a solid body 10, which is substantially parallelepiped-shaped, incorporating in its bulged front face 1 a lower quadrangular recess 2, such lower quadrangular recess extending almost through the whole depth of the parallel-shaped piece 10, and an inverted T-shaped recess 3 in its upper portion, the horizontal and lower part of the T-shaped recess 3 having the same depth as the lower quadrangular recess 2, while the vertical and upper part of the inverted T-shaped recess 3 has a depth equivalent to half the depth of the parallelepiped-shaped body 10, due to the fact that a trough-like insert 4 is centrally and vertically incorporated into the upper middle portion of such piece, such trough-like insert together with the inverted T-shaped upper recess 3 defining both an adjustable filling bed 3*a* of a tubular sleeve 11.

Figure 5:
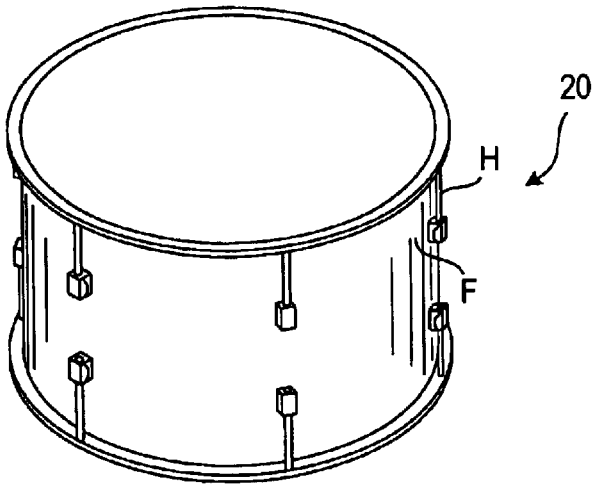
FIG. 5 is a perspective view of the percussion instrument provided with the tuning mechanism and the new constructive arrangement thereof.

The tubular sleeve 11 is internally threaded and provided with a rectangular base 12, which is snugly and able to slide fitted into such bed 3*a*. To the sleeve 11, the end of the tuning stem, designated H in FIG. 5, is axially threaded, the tuning stem end H going through the whole length of the tubular sleeve 11 and 12 to self-threading fasten to the intermediate horizontal wall 5 which is defined between the upper inverted T-shaped recess 3 and the lower quadrangular recess 2.

A through-hole is defined in the bottom wall of the lower quadrangular recess 2 coinciding with a tubular projection 6 which extends orthogonally from the back wall 7 of the solid parallelepiped-shaped body 10, the projection 6 being fitted into a corresponding hole (designated F in FIGS. 3 and 5) provided in the percussion instrument side wall 20, both being pierced through by a fastening screw 8.

The fastening screw 8 pierces through the projection 6 and the bottom wall 7, in such a way that its free and threaded end will appear inside the quadrangular recess 2, wherein a check nut 9 is received.

Figure 2:
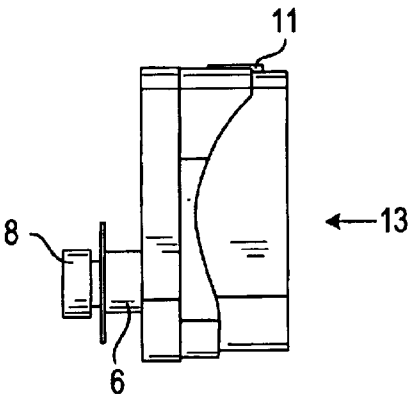
FIG. 2 is a side view of the tuning mechanism for percussion instruments.
Figure 1:
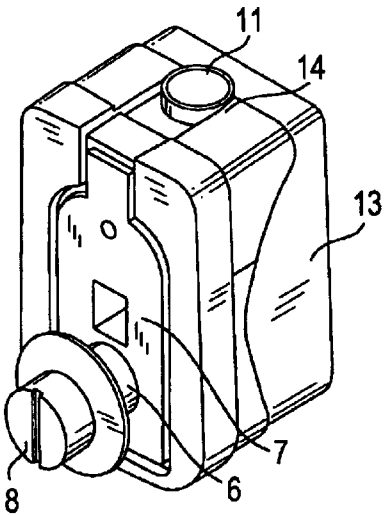
FIG. 1 is a rear perspective view of the tuning mechanism for percussion instruments, according to the new arrangement.
Figure 4:
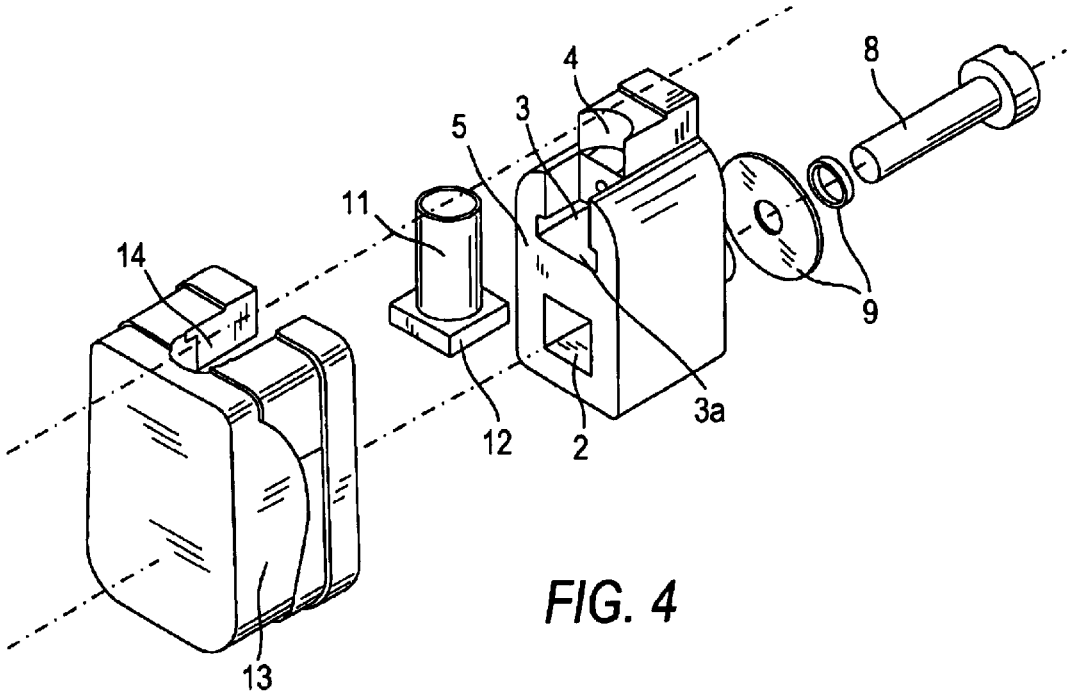
FIG. 4 is a perspective exploded and front view of the tuning mechanism not provided with the finish case, illustrating the solid body without the adjustably fitted sleeve of the tuning stem end.

As can be seen in FIGS. 1 and 2, the whole assembly mounted and adjusted with respect to the percussion instrument is covered with a finish case 13 having a parallel-shaped contour with a half-oblong recess 14 in the upper face thereof so as to ensure the press fit of the finish case 13 to the solid body 10, such case covering the whole assembly.

The finish case 13 is preferably made of plastic material and may have a metallic, glossy or dull finish, according to the type of plastic and the surface paint provided to it.

As it is a press-fit piece, the finish case 13 may be replaced at any time and according to the model of the percussion instrument 20 to which the mechanism 10 is employed.

With the foregoing description and illustrations, those skilled in the art will appreciate that modifications may be made to the invention without departing from the scope thereof.

What is claimed is:

1. Constructive arrangement disposed in a tuning mechanism for percussion instruments, comprising:

a substantially parallelepiped-shaped body having a front face, a back wall and an upper portion, said front face of said body including a lower recess extending substantially through a depth of said body, said upper portion of said body including an inverted T-shaped recess having a horizontally oriented lower part and a vertically oriented upper part, said body including a through-hole formed in a bottom wall of said lower recess;

a tubular sleeve having internal threads;

a rectangular base coupled to said sleeve;

an insert arranged in connection with said body and defining a trough, said insert and said T-shaped recess together defining an adjustable bed for said base and said sleeve;

said body including an intermediate wall defined between said T-shaped recess and said lower recess, said intermediate wall being adapted to be fastened to an end of a tuning stem which is threadable through said sleeve such that the end of the tuning stem passes through a length of said sleeve to be threadingly fastened to said intermediate wall;

a tubular projection extending perpendicularly from said back wall of said body and coincident with said through-hole in said bottom wall of the said lower recess, said projection being adapted to be arranged in a corresponding hole in a side wall of the percussion instrument;

a fastening screw for fastening said projection to the side wall of the percussion instrument; and a finish case having a parallelepiped-shaped contour defining a half oblong recess in an upper face to ensure press-fit of said finish case to said body, said finish case covering the arrangement.

2. The constructive arrangement of claim 1, wherein said lower recess has a rectangular cross section to thereby provide said lower recess with a quadrangular form.

3. The constructive arrangement of claim 2, wherein said lower part of said T-shaped recess has the same depth as said lower recess of said body and said upper part of said T-shaped recess has a depth equivalent to one-half the depth of said body.

4. The constructive arrangement of claim 3, wherein said insert is centrally and vertically incorporated into an upper middle portion of said body.

5. The constructive arrangement of claim 4, wherein said fastening screw is arranged to pierce both the hole in the side wall of the percussion instrument and said projection.

6. The constructive arrangement of claim 5, wherein said fastening screw has a free end arranged in said lower recess.

7. The constructive arrangement of claim 6, further comprising a check nut received in said lower recess engaging with said fastening screw.

8. The constructive arrangement of claim 7, wherein said T-shaped recess is arranged such that said base and said sleeve are slidable into said bed.

9. The constructive arrangement of claim 1, wherein said lower part of said T-shaped recess has the same depth as said lower recess of said body and said upper part of said T-shaped recess has a depth equivalent to one-half the depth of said body.

10. The constructive arrangement of claim 1, wherein said insert is centrally and vertically incorporated into an upper middle portion of said body.

11. The constructive arrangement of claim 1, wherein said fastening screw is arranged to pierce both the hole in the side wall of the percussion instrument and said projection.

12. The constructive arrangement of claim 1, wherein said fastening screw has a free end arranged in said lower recess.

13. The constructive arrangement of claim 12, further comprising a check nut received in said lower recess engaging with said fastening screw.

14. The constructive arrangement of claim 1, wherein said T-shaped recess is arranged such that said base and said sleeve are slidable into said bed.

* * * * *

UNITED STATES PATENT AND TRADEMARK OFFICE

CERTIFICATE OF CORRECTION

PATENT NO. : 6,700,045 B2
DATED : March 2, 2004
INVENTOR(S) : Marino Rampazzo Del Valhe It is certified that error appears in the above-identified patent and that said Letters Patent is hereby corrected as shown below:

Title page,
Item [73], Assignee, should read -- Instrumentos Musicais Ltda, Sao Paulo - SP - Brazil --

Signed and Sealed this

Tenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,700,045 B2
DATED : March 2, 2004
INVENTOR(S) : Marino Rampazzo Del Valhe It is certified that error appears in the above-identified patent and that said Letters Patent is hereby corrected as shown below:

Title page,
Insert Item:
-- [73] Assignee: RMV Instrumentos Musicais Ltda, Sao Paulo - SP -Brazil --
Item [30], Foreign Application Priority Data, should read
-- June 18, 2001 (BR) ……. MU-81014201 --

This certificate supersedes Certificate of Correction issued August 10, 2004.

Signed and Sealed this

Seventh Day of December, 2004

JON W. DUDAS
*Director of the United States Patent and Trademark Office*